US006776441B2

(12) United States Patent
Liu

(10) Patent No.: US 6,776,441 B2
(45) Date of Patent: Aug. 17, 2004

(54) LOCK ASSEMBLY WITH TWO HOOK DEVICES

(76) Inventor: Chuen-Yi Liu, No. 17-19, Shiah-Tsuoh Street, Der-Rong Tsuen, Charng-Jyh Shiang, Pingtung Hsien (TW)

( * ) Notice: Subject to any disclaimer, the term of this patent is extended or adjusted under 35 U.S.C. 154(b) by 0 days.

(21) Appl. No.: 10/298,407

(22) Filed: Nov. 18, 2002

(65) Prior Publication Data

US 2003/0116973 A1 Jun. 26, 2003

(30) Foreign Application Priority Data

Dec. 21, 2001 (TW) ..... 90222897 U

(51) Int. Cl.[7] ..... E05C 9/16

(52) U.S. Cl. ..... 292/26; 292/24; 292/27; 292/DIG. 46; 292/DIG. 60

(58) Field of Search ..... 292/24, 26, 27, 292/56, 118, DIG. 60, 196, DIG. 46

(56) References Cited

U.S. PATENT DOCUMENTS 2,739,002 A * 3/1956 Johnson ..... 292/24
2,916,317 A * 12/1959 Diday ..... 292/26
3,400,562 A * 9/1968 Bloss ..... 70/70
3,413,025 A * 11/1968 Sperry ..... 292/111
3,586,360 A * 6/1971 Perrotta ..... 292/26
3,899,201 A * 8/1975 Paioletti ..... 292/25
4,416,126 A * 11/1983 Remington ..... 70/71
5,702,134 A * 12/1997 Hsieh ..... 292/92
5,722,704 A * 3/1998 Chaput et al. ..... 292/26
5,820,170 A * 10/1998 Clancy ..... 292/26
5,906,403 A * 5/1999 Bestler et al. ..... 292/26
5,951,068 A * 9/1999 Strong et al. ..... 292/39
6,264,252 B1 * 7/2001 Clancy ..... 292/196
6,454,320 B1 * 9/2002 Weinerman et al. ..... 292/56
6,502,435 B2 * 1/2003 Watts et al. ..... 70/95
6,502,868 B1 * 1/2003 Laspa et al. ..... 292/26

* cited by examiner

*Primary Examiner*—Robert J. Sandy
*Assistant Examiner*—Thomas Ho
(74) *Attorney, Agent, or Firm*—Alan D. Kamrath; Nikolai & Mersereau, P.A.

(57) ABSTRACT

A lock assembly includes a casing, a pivotable member pivotally mounted in the casing, two linking rods each having a first end pivotally connected to the pivotable member and a second end, and two hook devices each including a first hook member and a second hook member. Each second hook member is pivotally mounted in the casing. The second end of each linking rod is pivotally connected to an associated second hook member. Each first hook member includes a first end pivotally connected to the second hook member. Each hook member further includes a hooked second end that is passable through an associated opening of the casing. When the pivotable member is pivoted, each first hook member is pivoted such that the hooked second end of each first hook member is moved between a retracted position in the casing and an extended position out of the casing.

7 Claims, 2 Drawing Sheets

LOCK ASSEMBLY WITH TWO HOOK DEVICES

BACKGROUND OF THE INVENTION

1. Field of the Invention

The present invention relates to a lock assembly with two hook devices for reliably locking a door.

2. Description of the Related Art

A wide variety of locks have heretofore been provided for different purposes. Typically, a lock includes a single latch bolt for providing the latching function. The latching function provided by the single latch bolt is apt to be destroyed. The present invention is intended to provide a lock assembly with two hook devices to solve this problem.

SUMMARY OF THE INVENTION

A lock assembly in accordance with the present invention comprises:

a casing having two openings;

a pivotable member pivotally mounted in the casing;

two linking rods respectively provided on two sides of the pivotable member, each said linking rod including a first end pivotally connected to the pivotable member and a second end; and two hook devices each including a first hook member and a second hook member, each said second hook member being pivotally mounted in the casing, the second end of each said linking rod being pivotally connected to an associated one of the second hook members, each said first hook member including a first end pivotally connected to said second hook member, each said hook member further including a hooked second end that is passable through an associated one of the openings of the casing;

wherein when the pivotable member is pivoted, each said first hook member is pivoted such that the hooked second end of each said first hook member is moved between a retracted position in the casing and an extended position out of the casing.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
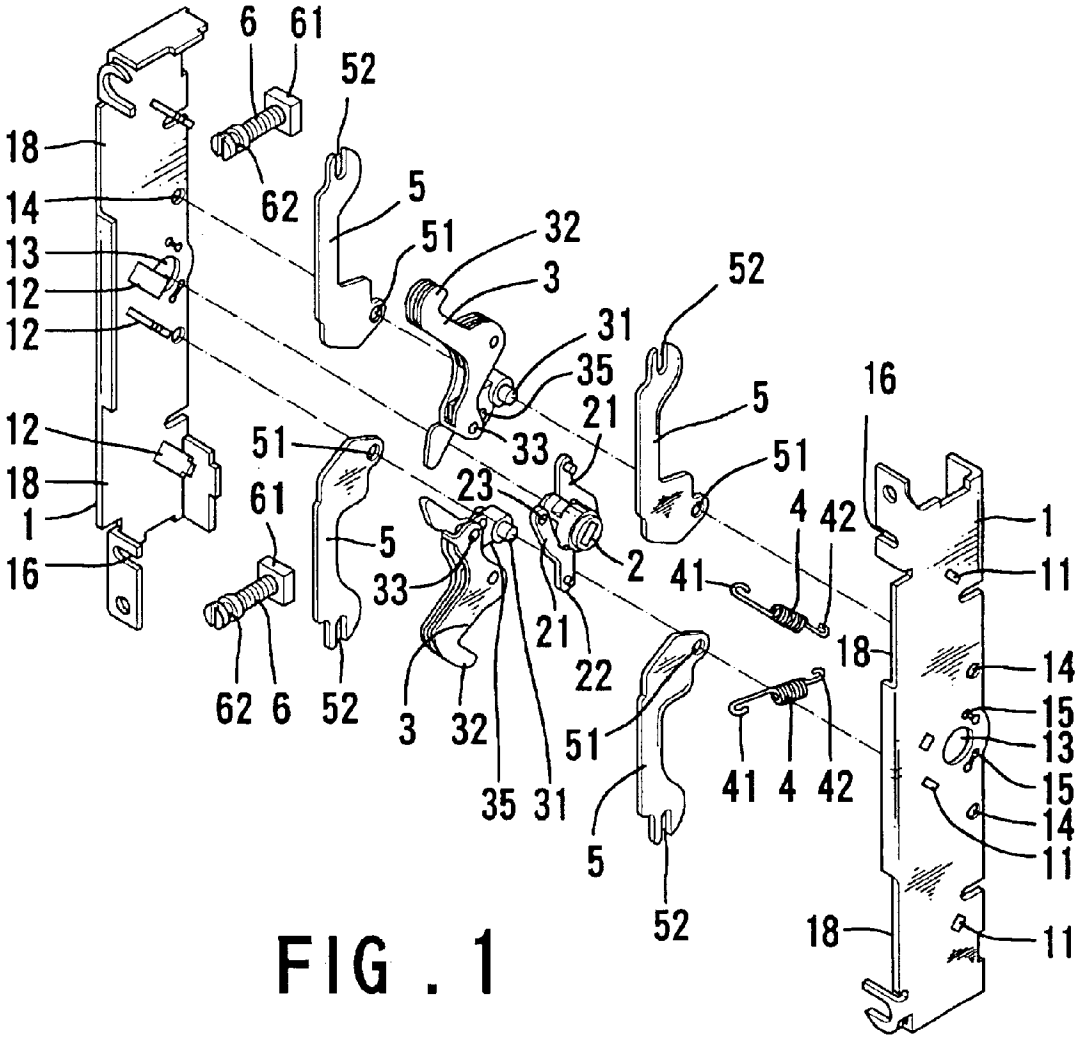
FIG. 1 is an exploded perspective view of a lock assembly in accordance with the present invention.
Figure 2:
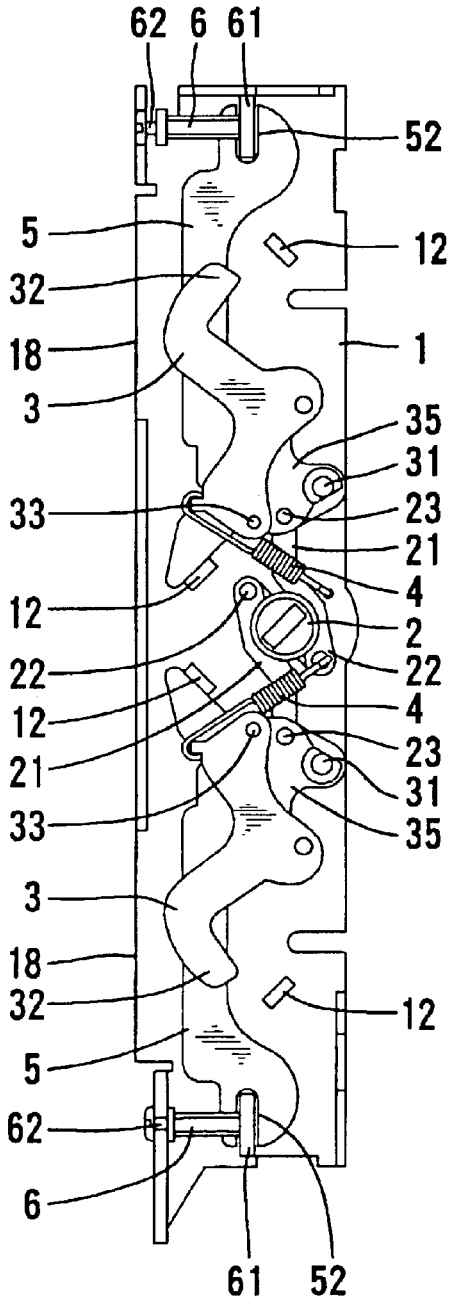
FIG. 2 is a side view of the lock assembly with one casing half being removed to show interior structure.

Referring to FIGS. 1 and 2, a lock assembly in accordance with the present invention generally comprises a casing consisting of two casing halves 1. One of the casing halves 1 (the right one in FIG. 1) includes a plurality of connecting holes 11, and the other casing half (the left one in FIG. 1) includes a plurality of engaging pieces 12 that are extended through the connecting holes 11 and then riveted, thereby securely engaging the casing halves 1 together.

A pivotable member 2 is pivotally mounted in the casing. In this embodiment, the pivotable member 2 is pivotally held in aligned holes 13 of the casing halves 1. Two linking rods 21 are respectively provided on two sides of the pivotable member 2 and each includes a first end 22 pivotally connected to the pivotable member 2 and a second end 23.

Two hook devices are mounted in the casing and each includes a first hook member 3 and a second hook member 35. The second hook member 35 includes a stub 31 that is pivotally engaged in aligned holes 14 of the casing halves 1. The second end 23 of each linking rod 21 is pivotally connected to an associated second hook member 35. Each first hook member 3 includes a first end 33 that is pivotally connected to an associated second hook member 35 and a hooked second end 32 that is movable between a retracted position in the casing (FIG. 2) and an extended position outside the casing (FIG. 3).

Two springs 4 are provided and each includes a first end 41 attached to an associated first hook member 3 and a second end 42 attached to, e.g., a FIG. 8 hole 15 in one of the casing halves (the right one in FIG. 1).

Figure 3:
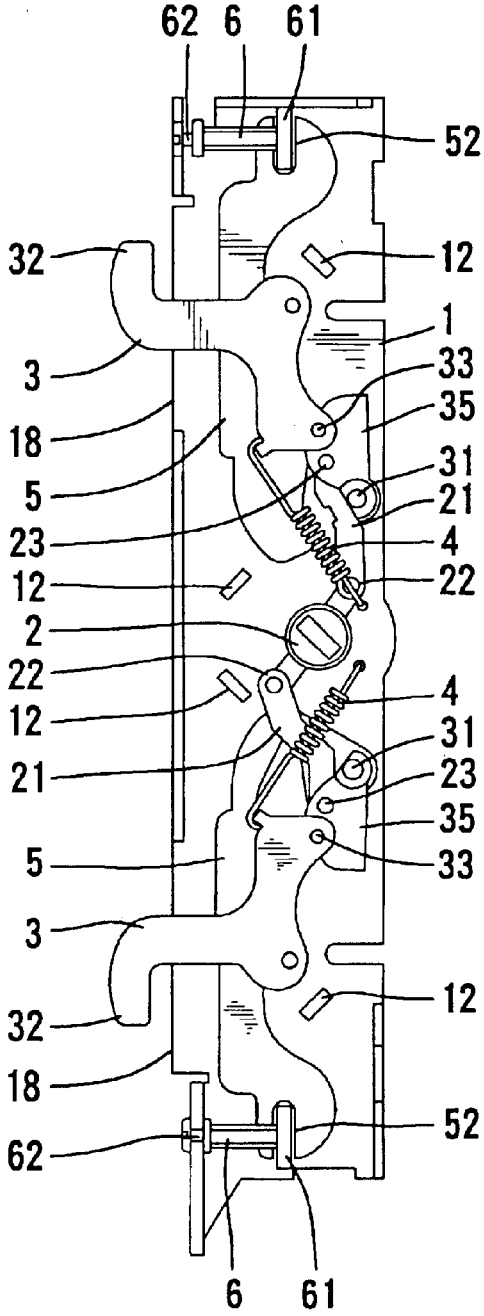
FIG. 3 is a side view similar to FIG. 2, illustrating a locking state of the lock assembly.

When the pivotable member 2 is driven by a shank (not shown) of a handle (not shown) or an actuating plate (not shown) of a lock core (not shown), each first hook member 3 is pivoted such that the hooked second end 32 is moved either to the retraced position shown in FIG. 2 or to the extended position shown in FIG. 3. It is noted that the casing includes two openings 18 that allow passage of the hooked second ends 32 of the first hook members 3. Thus, it takes a burglar longer to destroy the lock assembly in accordance with the present invention.

Still referring to FIGS. 1 and 2, the lock assembly in accordance with the present invention may further include two adjusting bolts 6 and two follower plates 5. Each adjusting bolt 6 includes an end plate 61 on an end thereof and a neck 62 on the other end thereof. The neck 62 of each adjusting bolt 6 is engaged in a notch 16 of an associated casing half 1. Each follower plate 5 includes a first end having a hole 51 that is extended through by the stub 31 of an associated second hook member 35. Each follower plate 5 further includes a second end having a notch 52 for engaging with the end plate 61 of an associated adjusting bolt 6. When the respective adjusting bolt 6 is turned, the end plate 61 of the respective adjusting bolt 6 is moved, which in turn causes pivotal movement of the respective follower plate 5. The angular position of the hooked second end 32 of the respective first hook member 3 is adjusted, thereby adjusting the extended length of the respective first hook member 3.

Although the invention has been explained in relation to its preferred embodiment, it is to be understood that many other possible modifications and variations can be made without departing from the scope of the invention as hereinafter claimed.

What is claimed is:

1. A lock assembly comprising:

a casing having two openings;

a pivotable member pivotally mounted in the casing;

two linking rods respectively provided on two sides of the pivotable member, each said linking rod including a first end pivotally connected to the pivotable member and a second end;

two hook devices each including a first hook member and a second hook member, each said second hook member being pivotally mounted in the casing, the second end of each said linking rod being pivotally connected to an associated one of the second hook members, each said first hook member including a first end pivotally connected to said second hook member, each said first hook member further including a hooked second end that is passable through an associated one of the openings of the casing;

wherein when the pivotable member is pivoted, each said first hook member is pivoted such that the hooked second end of each said first hook member is moved between a retracted position in the casing and an extended position out of the casing;

two follower plates; and two adjusting bolts, each said follower plate including a first end and a second end, each said adjusting bolt including a first end engaged with the second end of an associated one of the follower plates, each said adjusting bolt further including a second end;

wherein each said second hook member includes a stub pivotally received in two aligned holes of the casing;

wherein the first end of each said follower plate includes a hole through which the stub of an associated one of the second hook members extends; and wherein when each said adjusting bolt is turned, an associated one of the follower plates and an associated one of the second hook member are pivoted, thereby changing an extended length of an associated one of the first hook members.

2. The lock assembly as claimed in claim 1, wherein the casing consists of two casing halves.

3. The lock assembly as claimed in claim 2, wherein the second end of each said follower plate includes a notch, and wherein the first end of each said adjusting bolt includes an end plate that is engaged in the notch of an associated one of the follower plates.

4. The lock assembly as claimed in claim 3, wherein the second end of each said adjusting bolt includes a neck, and wherein the casing includes a notch for receiving the neck.

5. The lock assembly claimed in claim 1, wherein the second end of each said follower plate includes a notch, and wherein the first end of each said adjusting bolt includes an end plate that is engaged in the notch of an associated one of the follower plates.

6. The lock assembly as claimed in claim 5, wherein the second end of each said adjusting bolt includes a neck, wherein the casing includes a notch for receiving the neck.

7. The lock assembly as claimed in claim 1, wherein the second end of each said adjusting bolt includes a neck, and wherein the casing includes a notch for receiving the neck.

* * * * *